US005365827A

United States Patent [19]

Morita

[11] Patent Number: 5,365,827

[45] Date of Patent: Nov. 22, 1994

[54] CYLINDER APPARATUS AND METHOD OF CONTROLLING SAME

[75] Inventor: Masatoshi Morita, Kawasaki, Japan

[73] Assignee: Canon Kabushiki Kaisha, Tokyo, Japan

[21] Appl. No.: 9,072

[22] Filed: Jan. 26, 1993

[30] Foreign Application Priority Data

Jan. 31, 1992 [JP] Japan ..... 4-016335

[51] Int. Cl.[5] ..... F01B 25/26; F01B 31/12; F01B 1/00

[52] U.S. Cl. ..... 91/1; 91/165

[58] Field of Search ..... 91/451, 452, 463, 465, 91/466, 531

[56] References Cited

U.S. PATENT DOCUMENTS

| | | | |
|---|---|---|---|
| 3,479,924 | 11/1969 | Ferguson | 91/165 |
| 3,982,469 | 9/1976 | Bianchetta | 91/531 X |
| 4,106,390 | 8/1978 | Kodaira et al. | 91/361 X |
| 4,628,499 | 12/1986 | Hammett | 91/361 X |
| 4,932,311 | 6/1990 | Mibu et al. | 91/165 X |

FOREIGN PATENT DOCUMENTS 3219730 12/1983 Germany ..... 91/361

*Primary Examiner*—Edward K. Look
*Assistant Examiner*—John Ryznic
*Attorney, Agent, or Firm*—Fitzpatrick, Cella, Harper & Scinto

[57] ABSTRACT

A cylinder apparatus and a method of controlling the same allow an object to be moved at high speed and provide a decelerating force that can be changed with ease in conformity with the type of object. The apparatus includes a cylinder, a piston, an air supply source, a first pressure regulator for feeding compressed air of a first pressure into one chamber of the cylinder, a second pressure regulator for feeding compressed air of a second pressure into a second chamber of the cylinder, a first solenoid valve, a second solenoid valve, a deceleration-position sensor for sensing a position at which the piston begins deceleration, a stopping-position sensor for sensing that the piston is situated at an end of the cylinder, and controller for controlling the first and second solenoid valves.

3 Claims, 6 Drawing Sheets

CYLINDER APPARATUS AND METHOD OF CONTROLLING SAME

BACKGROUND OF THE INVENTION

This invention relates to a cylinder apparatus driven by pneumatic pressure, as well as to a method of controlling the cylinder apparatus.

In the prior art, speed control of a pneumatic cylinder apparatus is carried out by an arrangement of the kind shown in FIG. 1. The construction of this conventional pneumatic cylinder apparatus will be described with reference to FIG. 1.

As shown in FIG. 1, an air supply source 122 is a source for supplying compressed air to a pneumatic rodless cylinder 102. Connected to the air supply source 122 is a filter 120 for removing impurities such as oil from the air supplied by the air supply source 122. A pressure regulator 118 is connected to the filter 120. Accordingly, after the air supplied by the air supply source 122 has any impurities removed via the filter 120, the air is elevated to a predetermined pressure by the pressure regulator 118. The air thus elevated in pressure by the pressure regulator 118 is supplied to a 2-position 3-port solenoid valve 112 whence the air is supplied to the pneumatic rodless cylinder 102 via a speed control valve 106 or 108.

A solenoid 110 is connected to the solenoid valve 112. By turning the solenoid 110 on and off as necessary, the position of the solenoid valve 112 is changed over to switch between a state in which the compressed air from the pressure regulator 118 is supplied to a first air chamber 102*a* of the pneumatic rodless cylinder 102 and a state in which the compressed air is supplied to a second air chamber 102*b* of the pneumatic rodless cylinder 102. A muffler 114 and a muffler 116 are connected to respective ones of two ports of the solenoid valve 112. Air discharged from one air chamber of the pneumatic rodless cylinder 102 is released into the atmosphere.

The movement and operation of a piston 104 in the conventional pneumatic cylinder apparatus thus constructed will now be described.

Operation for moving the piston 104 from the left side to the right side in FIG. 1 will be described. First, the solenoid 110 connected to the solenoid valve 112 is placed in the OFF state to place the solenoid valve 112 in the position shown in FIG. 1. In this state, the air from the air supply source 122 is fed into the pressure regulator 118 and air at a predetermined pressure is discharged from the pressure regulator 118. The compressed air discharged from the pressure regulator 118 is supplied to the speed control valve 108 upon passing successively through a second port 112*a*2 and a fourth port 112*a*4 of the first chamber of 112*a* of solenoid valve 112. The air that has passed through the speed control valve 108 is supplied to the first air chamber 102*a* of the pneumatic rodless cylinder 102. As a result, pressure for moving the piston 104 to the right is produced in the first air chamber 102*a*.

Meanwhile, the air in the second air chamber 102*b* of the pneumatic rodless cylinder 102 is charged from the muffler 114 upon passing successively through the speed control valve 106 and a fifth port 112*a*5 and third port 112*a*3 of the solenoid valve 112. When the air is charged from the interior of the second air chamber 102*b*, the flow rate of the air discharged is regulated by the speed control valve 106 so that the traveling speed of the piston 104 is controlled so as to be rendered constant.

If the position of the solenoid valve 112 is changed over by the solenoid 110 when the piston 104 is moved from the right to the left side, compressed air is fed into the second air chamber 102*b* of the pneumatic rodless cylinder 102 and the air within the first air chamber 102*a* is discharged into the atmosphere. The position 104 is moved from the right to the left side.

However, a problem is encountered in the example of the prior art mentioned above. Specifically, consider the operation for moving the piston 104 from the left side to the right side, by way of example. Since the speed at which the air is discharged from the second air chamber 102*b*, namely the air chamber on the side at which discharge takes place, is limited by the speed control valve 106, the piston 104 is acted upon by a reaction force produced by the pressure within the second air chamber 102*b*. Consequently, acceleration of the piston 104 at starting time declines and, hence, movement of the piston takes time.

As an expedient for solving this problem, a method has been considered in which, by way of example, the air chamber on the discharge side is connected directly to the muffler without providing the speed control valve, thereby making it easier for the air to be discharged. In the case of this arrangement, the piston can no longer be controlled so as to move at a constant speed, but the arrangement is effective in a case where movement of the piston at very high speed is required more than movement of the piston at a constant speed.

However, in a case where the speed control valve is not connected to the air chamber on the discharge side, as described above, the piston 104 travels at high speed and back pressure that applies braking to movement of the piston 103 vanishes. This makes it necessary to provide a device such as a shock absorber, rather than a speed control valve, for the purpose of braking the piston 104. In is well known to employ a shock absorber that utilizes the elastic force of a spring for this purpose. If a strong spring force is used, however, the piston undergoes sudden deceleration and a large impact force acts upon the object being moved by the pneumatic cylinder. In the case of a weak spring force, the piston is not decelerated completely and strikes the wall surface of the cylinder, as a result of which the object being moved is still subjected to an impact force.

Since the optimum value of the above-mentioned spring force differs depending upon the weight of the object moved, it is required that the spring force be adjusted in dependence upon the type of object moved. The problem that arises is that this adjustment requires labor.

In a case where the object moved is of great weight, a very large shock absorber becomes necessary in order to absorb the kinetic energy of the object. In addition, the size of the pneumatic cylinder is enlarged owing to the space needed to install this shock absorber.

SUMMARY OF THE INVENTION

Accordingly, an object of the present invention is to provide a cylinder apparatus, and a method of controlling the same, so adapted that the object moved can be moved at high speed and a decelerating force can be changed with ease in conformity with the type of object.

Another object of the present invention is to provide a cylinder apparatus, and a method of controlling the same, in which a pneumatic cylinder can be made as small as possible.

According to the present invention, a cylinder apparatus that attains the foregoing objects comprises a cylinder, a piston provided within the cylinder in a state it which interior space of the cylinder is partitioned into a first chamber situated on one side of the cylinder in the direction in which the cylinder extends and a second chamber situated on another side of the cylinder, the piston being movable along the direction in which the cylinder extends, at least one air supply source which supplies air for being fed into the first and second chambers, first feeding means for feeding compressed air of a first pressure into one of the first and second chambers in order to move the piston along the direction in which the piston extends, discharge means for discharging air from the other of the first and second chambers in order to move the piston along the direction in which the piston extends, second feeding means for feeding compressed air of a second pressure lower than the first pressure into the other chamber in order to decelerate speed of movement of the piston, first changeover means for changing over between a state in which the first feeding means is connected to the first chamber and a state in which the first feeding means is connected to the second chamber, second changeover means for changing over between a state in which the second feeding means is connected to the second chamber and a state in which the second feeding means is connected to the first chamber, third changeover means for changing over among a state in which the discharge means is connected to the first chamber, a state in which the discharge means is connected to the second chamber and a state in which the discharge means is connected to both the first and second chambers, pressure changing means for changing a pressure value of the second pressure, first sensing means for sensing a position at which the speed of movement of the piston is to begin deceleration when the piston is moved from the one side to the other side, second sensing means for sensing a position at which the speed of movement of the piston is to begin deceleration when the piston is moved from the other side to the one side, third sensing means for sensing that the piston is situated on the one side of the cylinder, fourth sensing means for sensing that the piston is situated on the other side of the cylinder, and control means for controlling the first through third changeover means based upon detection signals from the first through fourth sensing means.

Further, according to the present invention, a method of controlling a cylinder apparatus comprises a first step of moving a piston along a direction in which the cylinder extends by feeding compressed air of a first high pressure into one of two chambers partitioned from each other by the piston and discharging air from the other of the two chambers, and a second step of decelerating speed of movement of the piston by feeding air of a second high pressure, which is lower than the first high pressure, into the other of the chambers.

The cylinder apparatus and control method thereof are arranged as set forth above. As a result, the piston is capable of being moved at high speed by discharging air from the other of the chambers at the same time that compressed air of the first pressure is fed into the one chamber of the cylinder partitioned by the piston. Further, air of the second pressure lower than the first pressure is fed into the other chamber when the piston has reached a predetermined position, and the second pressure is changed, whereby a decelerating force suited to the weight of the object moved can be applied to the piston.

Further, the piston is braked by feeding the compressed air into the other chamber of the cylinder. As a result, no space is required for installing a spring-type shock absorber and, hence, the cylinder can be made more compact.

Other objects and advantages besides those discussed above shall be apparent to those skilled in the art from the description of a preferred embodiment of the invention which follows. In the description, reference is made to accompanying drawings, which form a part thereof, and which illustrate an example of the invention. Such example, however, is not exhaustive of the various embodiment of the invention, and therefore reference is made to the claims which follow the description for determining the scope of the invention.

DESCRIPTION OF THE PREFERRED EMBODIMENTS

Preferred embodiments of the present invention will now be described in detail with reference to the accompanying drawings.

First Embodiment

Figure 1:
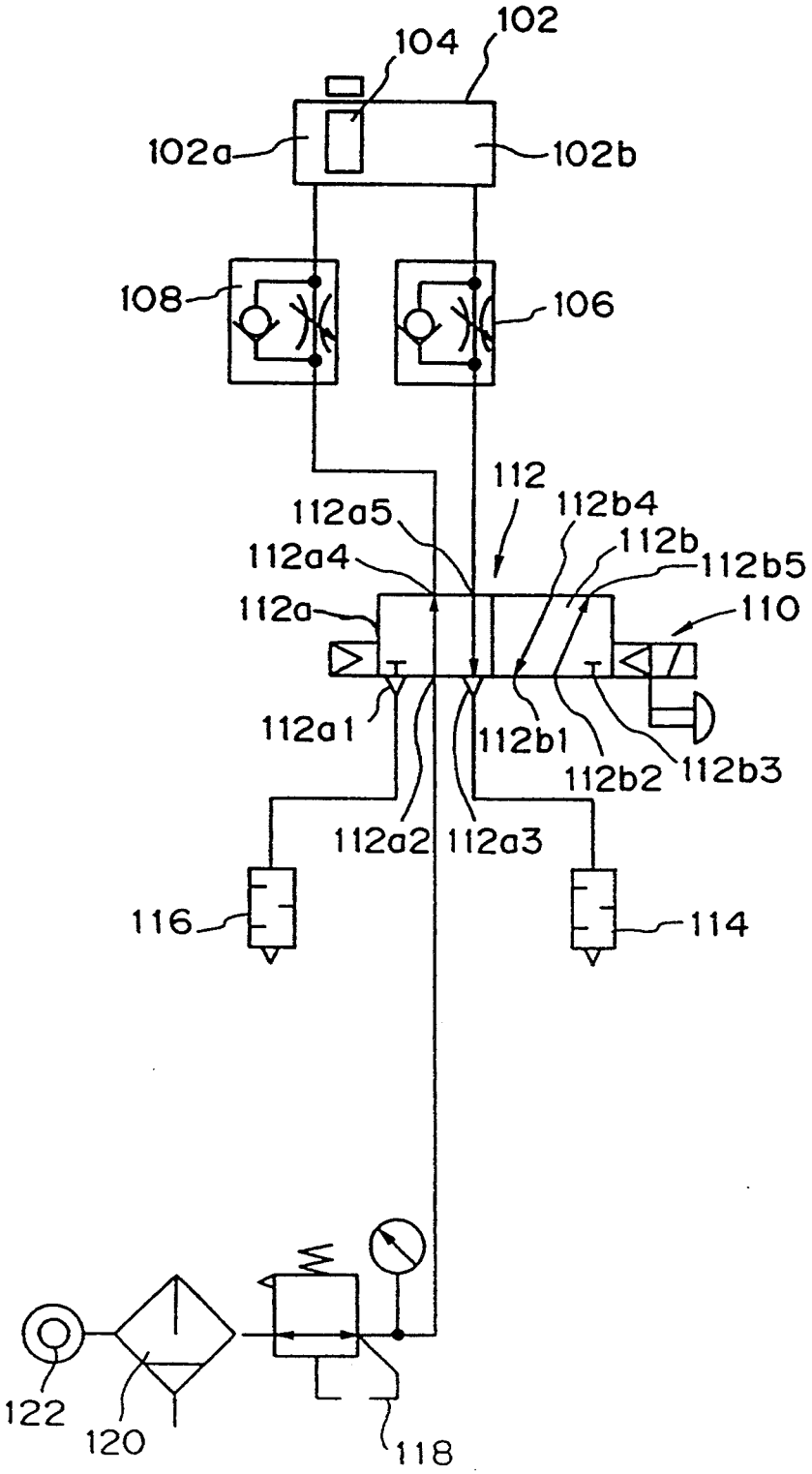
FIG. 1 (PRIOR ART)
FIG. 1 is a pneumatic circuit diagram showing the arrangement of a conventional cylinder apparatus.
Figure 2:
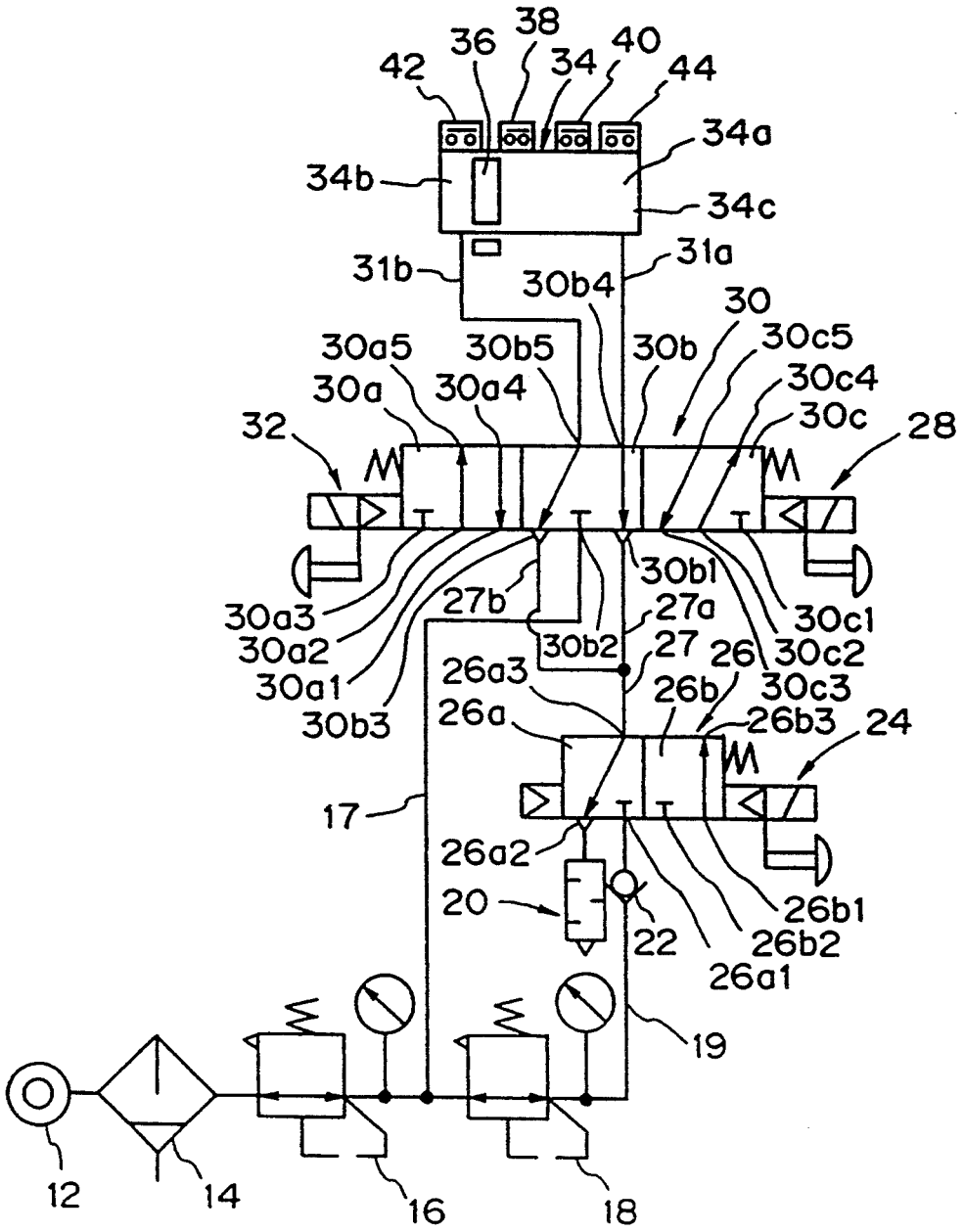
FIG. 2 is a pneumatic circuit diagram showing the arrangement of a cylinder apparatus according to a first embodiment of the invention.

FIG. 2 is a pneumatic circuit diagram showing the arrangement of a cylinder apparatus according to a first embodiment of the present invention.

As shown in FIG. 2, an air supply source 12 is a source for applying compressed air to a pneumatic rodless cylinder 34. Connected to the air supply source 12 is a filter 14 for removing impurities such as oil from the air supplied by the air supply source 12. A first pressure regulator 16 is connected to the filter 14 and operates to regulate the pressure of the air from the air supply source to a first high pressure (e.g., 490 KPa (5 kgf/cm$^2$). The air flow passageway downstream of the pressure regulator 16 branches in two directions. One of these paths is connected to a second pressure regulator 18 and the other is connected to a second port **30*b*2 of a second solenoid valve 30 via a branch line 17**.

The second pressure regulator 18 regulate the pressure of the air supplied by the air supply source 12 to a second high pressure (e.g., 294 KPa (3 kgf/cm$^2$). As a result of the air at the second high pressure, a braking force is applied to a piston 36 by a method set forth below. The braking force that acts upon the piston 36 can be changed by changing the second high pressure. A first solenoid valve 26 is connected to the second pressure regulator 18 at a point downstream. thereof via a check valve 22. The first solenoid valve 26 is a 2-position 3-port solenoid valve adapted so as to be changed over to either of the two positions by a solenoid 24 connected to this solenoid valve. With the solenoid 24 in the OFF state, the first solenoid valve 26 is in the state shown in FIG. 2, as a result of which the compressed air that has passed through the check valve 22 is supplied to a first port **26*a*1 of the first solenoid valve 26. Under these conditions, the first port 26*a*1 is in the closed state, as illustrated, and therefore the compressed air supplied from the second pressure regulator 18 to the first port 26*a*1 via the check valve 22** is in a sealed state.

Meanwhile, a muffler 20 is connected to a second port **26*a*2 of a first chamber 26*a*. As will be described below, air discharged from two air chambers 34*a*, 34*b* of the pneumatic cylinder 34 is released into the atmosphere from the muffler 20. In order that the air thus discharged from the air chambers of the pneumatic cylinder 34 may be introduced to the muffler 20, an air passageway 27 is connected to a third port 26*a*3 of the first solenoid valve 26. The passageway upstream of the air passageway 27 branches into air passageway 27*a* and 27*b*. The air passageway 27*a* is connected to a first port 30*b*1 of the second solenoid valve 30, and the second air passageway 27*b* is connected to a third port 30*b*3 of the second solenoid valve 30**.

The second solenoid valve 30 is a 3-position 5-port solenoid valve adapted so as to be changed over to any of the three positions by solenoids 28, 32. With the solenoids 28, 32 in the OFF state, the second solenoid valve 30 is in the state illustrated in FIG. 2, as a result of which the compressed air that has passed through the branch line 17 is supplied to the second port **30*b*2 of the second solenoid valve 30. Under these conditions, the second port 30*b*2 is in the closed state, as shown, and therefore the compressed air supplied from the first pressure regulator 16 to the second port 30*b*2 via the branch line 17** is in the sealed state.

Further, under these conditions, an air passageway **31*a* connected to the first air chamber 34*a* of the pneumatic cylinder 34 is connected to a fourth port 30*b*4 of the second solenoid valve 30, and an air passageway 31*b* connected to the second air chamber 34*b* is connected to a fifth port 30*b*5 of the second solenoid valve 30. Accordingly, with all of the solenoids 24, 28, 32 in the OFF state, the first and second air chambers 34*a*, 34*b* of the pneumatic cylinder 34 are both opened to the atmosphere via the muffler 20**.

The pneumatic cylinder 34 has a pneumatic cylinder body **34*c* in the interior of which the piston 36 is provided. The piston 36 is moved longitudinally of the pneumatic cylinder body 34*c*, whereby an object secured to the piston 36 is moved. Owing to supply of compressed air to the first air chamber 34*a* and discharge of air from the second air chamber 34*b*, the piston 36 is moved from the right side to the left side in FIG. 2 relative to the pneumatic cylinder body 34*c*. Conversely, owing to supply of compressed air to the second air chamber 34*b* and discharge of air from the first air chamber 34*a*, the piston 36 is moved from the left side to the right side in FIG. 2 relative to the pneumatic cylinder body 34*c***.

The pneumatic cylinder body **34*c* is equipped with four position sensors for sensing positions of the piston 36. Two of the four position sensors are deceleration-position sensors 38, 40 for sensing positions at which deceleration of the piston 36 is to start, and the other two are stopping position sensors 42, 44 for sensing the stopping positions of the piston 36**.

When the piston 36 is moved from the right side to the left side in FIG. 2, the deceleration-position sensor 38 senses that the piston 36 has passed in front of it and then commands the start of deceleration. The stopping-position sensor 42 senses that the piston 36 has finished moving and has arrived at the left end of the pneumatic cylinder body **34*c***.

Similarly, when the piston 36 is moved from the left side to the right side in FIG. 2, the deceleration-position sensor 40 senses that the piston 36 has passed in front of it and then commands the start of deceleration. The stopping-position sensor 44 senses that the piston 36 has finished moving and has arrived at the right end of the pneumatic cylinder body **34*c***.

Figure 3:
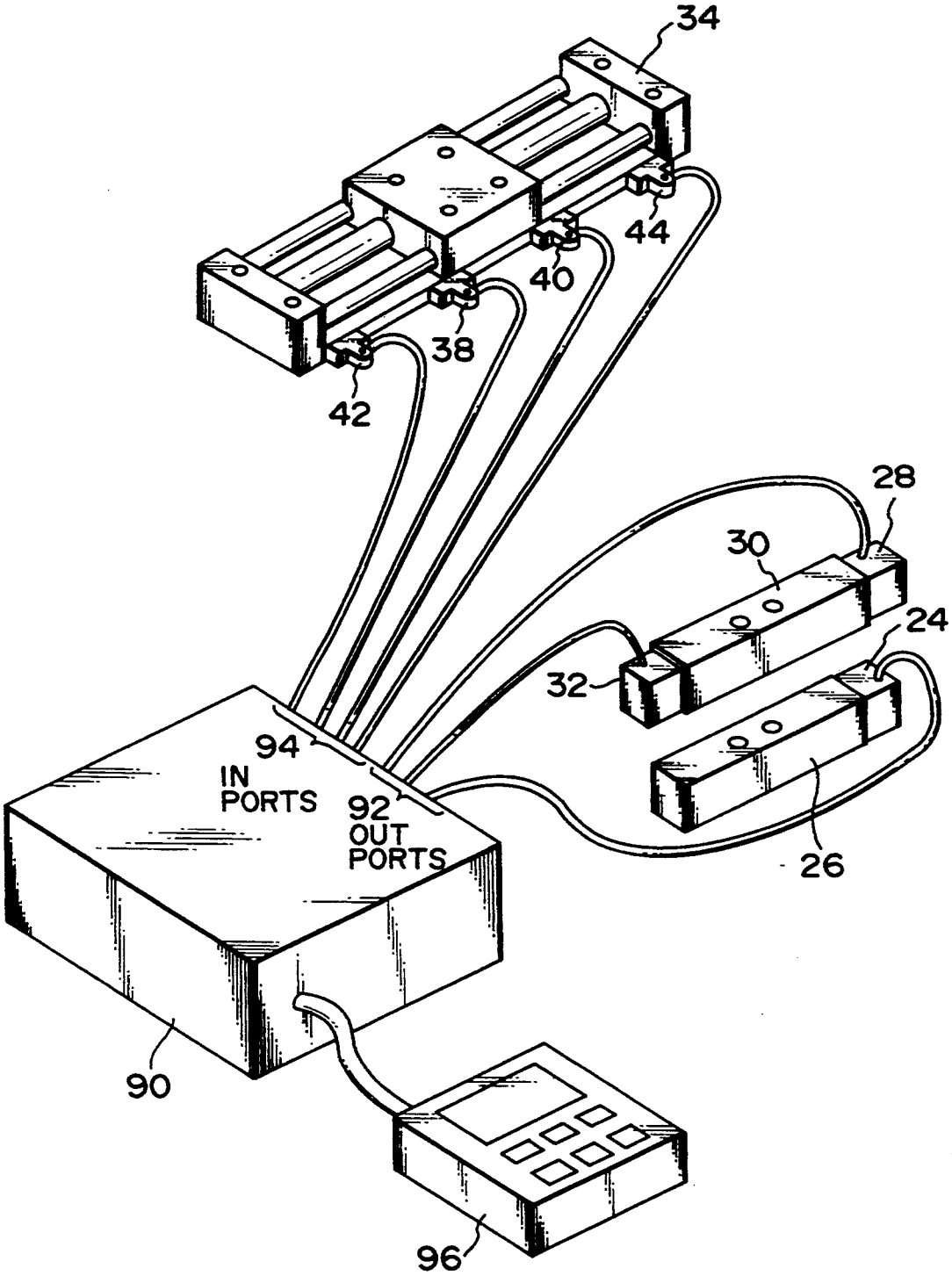
FIG. 3 is a perspective view showing a controller connected to solenoids and position sensors.

FIG. 3 is a perspective view showing the manner in which a controller is connected to solenoids and position sensors.

In FIG. 3, a controller 90 controls the overall cylinder apparatus and is equipped with a plurality of OUT ports 92 for outputting electric signals used in control, and a plurality of IN ports 94 to which input signals for control are applied. More specifically, the OUT ports 92 are at least three in number. These three ports are connected to the solenoid 24 of the first solenoid valve 26 and the solenoids 28, 32 of the second solenoid valve. The IN ports 94 include at least four ports, which are connected to the deceleration-position sensors 38, 40 and the stopping-position sensors 42, 44.

An input unit 96 for inputting a program that controls the entire cylinder apparatus is connected to the controller 90. The latter is adapted to control the output timing of signals outputted to the OUT ports 92 based upon the detection-signal information inputted to the IN ports 94 as well as the program inputted from the input unit 96.

Figure 4:
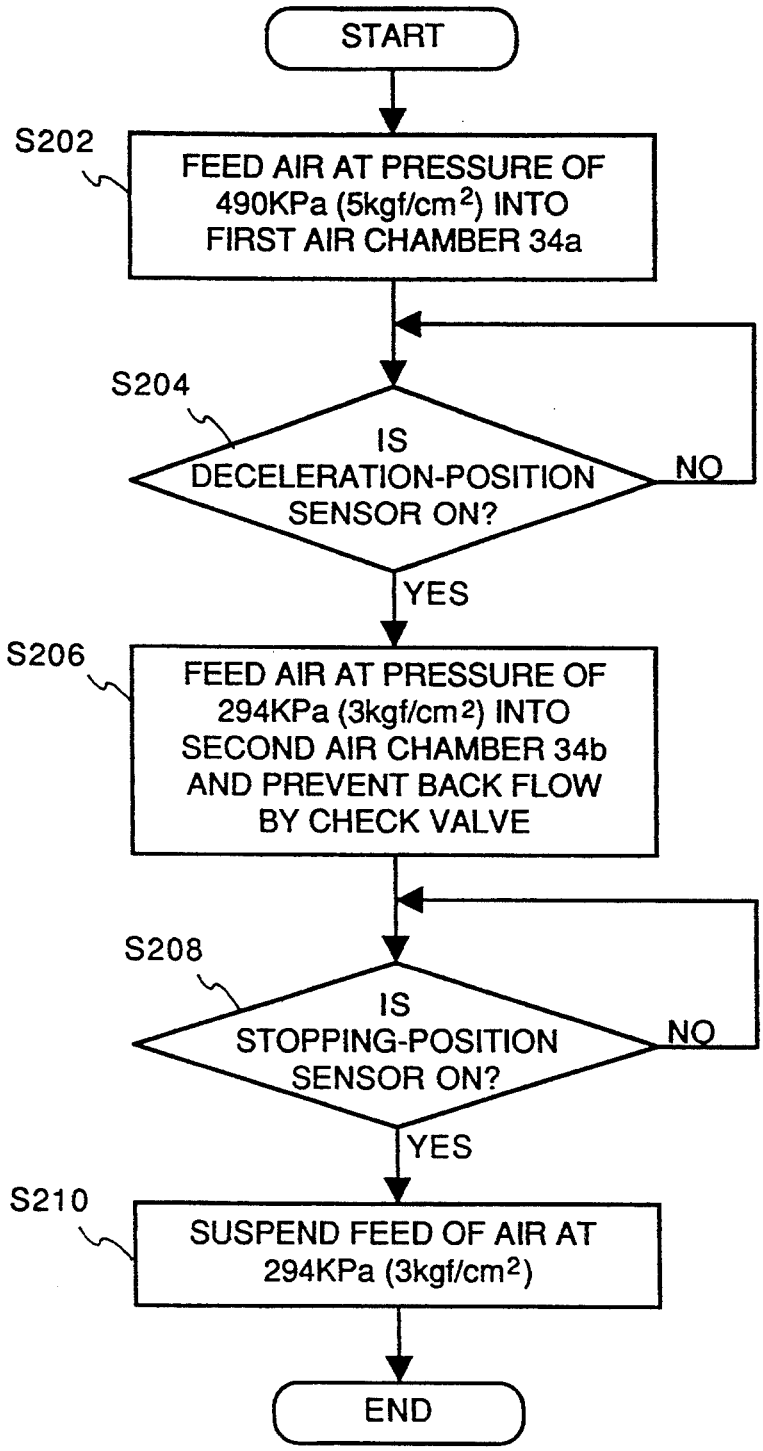
FIG. 4 is a flowchart showing an operation performed when a piston in a pneumatic cylinder is moved from a right end to a left end in FIG. 2.

Reference will now be had to the flowchart of FIG. 4 to describe the operation through which the piston of the pneumatic cylinder is moved from the right end to the left end of the cylinder in FIG. 2 by the cylinder speed control apparatus constructed as set forth above.

First, all of the solenoids 24, 28, 32 are OFF in the initial state (the state shown in FIG. 2), and it is assumed that the piston 36 is situated at the right end of the pneumatic pressure cylinder body **34*c* in FIG. 2**.

Starting from these conditions, the controller 90 executes step S202 in FIG. 4, which involves outputting a signal from the OUT port 92 to turn on one solenoid 28 of the second solenoid valve 30 so as to connect the second port **30*c*2 of the third chamber 30*c* of second solenoid valve 30 to the branch line 17 and connect the fourth port 30*c*4 to the air passageway 31*a*, as a result of which compressed air at a pressure of 490 KPa (5 $kgf/cm^2$) is fed into the first chamber 34*a* of pneumatic cylinder 34 from the first pressure regulator 16. At the same time, the third port 30*c*3 of the third chamber 30*c* of second solenoid valve 30 is connected to the air passageway 27*b* and the fifth port 30*c*5 is connected to the air passageway 31*b* so that the air within the second air chamber 34*b* of the pneumatic cylinder 34 is discharged into the atmosphere from the muffler 20 via the first solenoid valve 26. As a result, the piston 36 begins to be moved from the right side to the left side with respect to the pneumatic cylinder body 34*c*. At this time, as described above, the air in the second air chamber 34b is released into the atmosphere without meeting any resistance. Accordingly, almost no reaction force produced by pressure within the second air chamber 34b acts upon the piston 36 and therefore the piston 36** begins moving at very high speed.

Next, at step S204, the controller 90 stands by until the piston 36 has moved to the position of the deceleration-position sensor 38 and the latter has responded by feeding a detection signal into the controller 90 from the IN port 94. When the detection signal enters from the IN port 94, the program proceeds to step S206.

The controller 90 turns on the solenoid 24 of the first solenoid valve 26 at step S206. As a result, the first port 26b1 of the second chamber 26b of first solenoid valve 26 is connected to an air passageway 19 and the third port 26b3 is connected to the air passageway 27 so that compressed air at a pressure of 294 KPa (3 kgf/cm$^2$) is fed into the second chamber 34b of pneumatic cylinder 34 from the second pressure regulator 18. At this time the compressed air from the second pressure regulator 18 is prevented from flowing back by the check valve 22. Consequently, there is no back flow of air from the second air chamber 34b of the pneumatic cylinder 34 and the pressure of the second air chamber 34b rises in reliable fashion. The piston 36 starts decelerating as a result. The decelerating force produced at this time is capable of being changed by varying the set value of second pressure using the second pressure regulator 18.

Next, at step S208, the controller 90 stands by until the piston 36 has moved to the position of the stopping-position sensor 42 (the position at the left end of the pneumatic cylinder body 34c) and the latter has by responded by feeding a detection signal into the controller 90 from the IN port 94. When the detection signal enters from the IN port 94 at step S208, the program proceeds to step S210.

Since the controller 90 has verified that the piston 36 has already been moved to the left end of the pneumatic cylinder body 34c, the controller 90 delivers a control signal from the OUT port 92 to turn off the solenoid 24 of the first solenoid valve 26. As a result, the first solenoid valve 26 returns to the state shown in FIG. 2 (though it should be noted that the second solenoid valve 30 is not in the state shown in FIG. 2) so that the compressed air being held between the second air chamber 34b of the pneumatic cylinder 34 and the first solenoid valve 26 is discharged into the atmosphere from the muffler 20.

Further, the controller 90 measures the time that has elapsed from entry of the detection signal from the IN port 94 in response to operation of the stopping-position sensor 42. At elapse of 0.5 sec, the controller 90 delivers a signal from the OUT port 92 to turn off the solenoid 28 of the second solenoid valve 30. As a result, the second solenoid valve 30 returns to the state shown in FIG. 2 so that the compressed air being held between the first air chamber 34a of the pneumatic cylinder 34 and the second solenoid valve 30 is discharged into the atmosphere from the muffler As a result of the foregoing operation, the pressure in the first air chamber 34a and second air chamber 34b of the pneumatic cylinder 34 become the same as atmospheric pressure approximately one second after the solenoid 28 is turned off. This ends the operation through which the piston 36 is moved from the right end to the left end of the cylinder in FIG. 2.

Next, the operation through which the piston 36 is moved from the left end to the right end of the cylinder will be described with reference to the flowchart of FIG. 5.

First, all of the solenoids 24, 28, 32 are OFF in the initial state, and it is assumed that the piston 36 is situated at the left end of the pneumatic pressure cylinder body 34c in FIG. 2.

Figure 5:
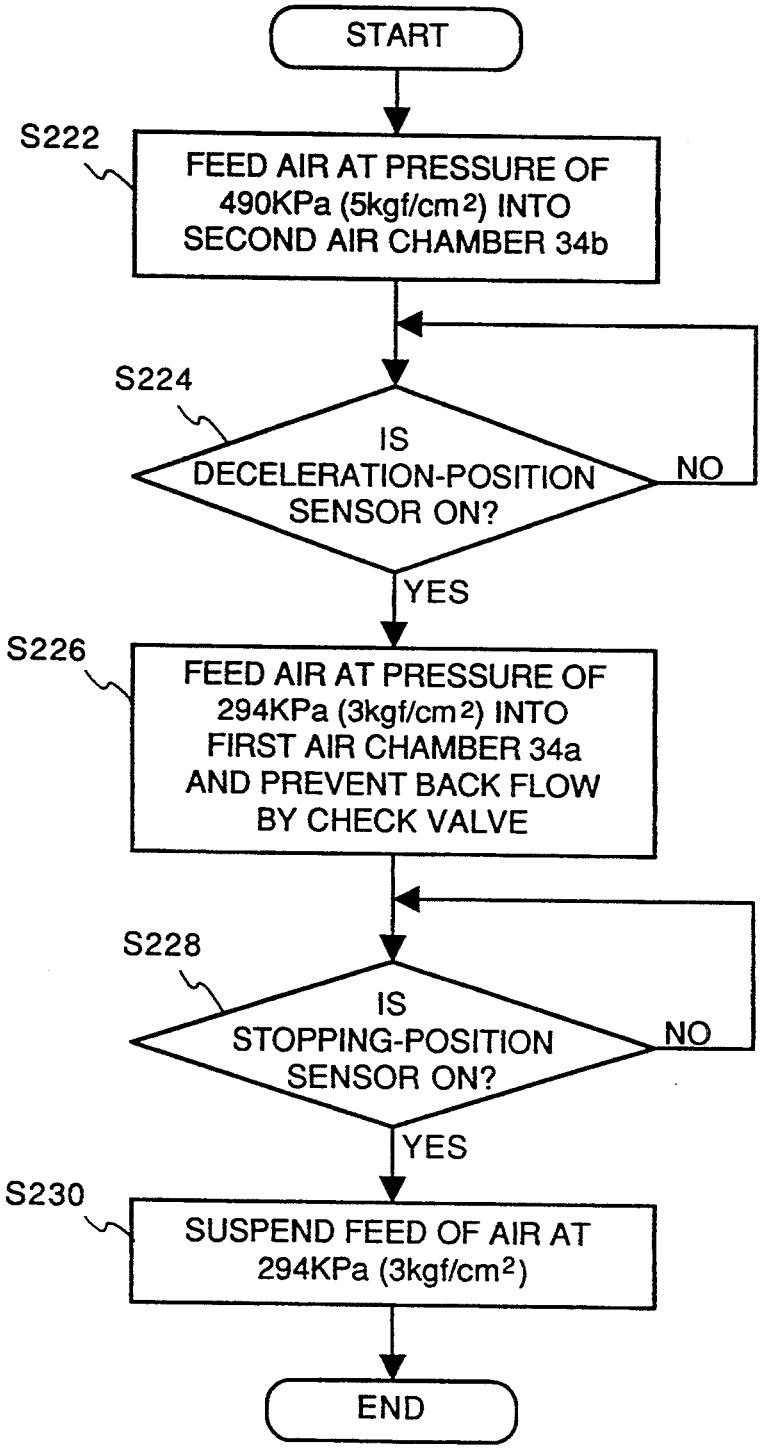
FIG. 5 is a flowchart showing an operation performed when the piston in the pneumatic cylinder is moved from a left end to a right end in FIG. 2.

Starting from these conditions, the controller 90 executes step S222 in FIG. 5, which involves outputting a signal from the OUT port 92 to turn on one solenoid 32 of the second solenoid valve 30 so as to connect the second port 30a2 of the first chamber 30a of second solenoid valve 30 to the branch line 17 and connect the fifth port 30a5 to the air passageway 31b, as a result of which compressed air at a pressure of 490 KPa (5 kgf/cm$^2$) is fed into the second chamber 34b of pneumatic cylinder 34 from the first pressure regulator 16. At the same time, the first port 30a1 of the first chamber 30a of second solenoid valve 30 is connected to the air passageway 27a and the fourth port 30a4 is connected to the air passageway 31a so that the air within the first air chamber 34a of the pneumatic cylinder 34 is discharged into the atmosphere from the muffler 20 via the first solenoid valve 26. As a result, the piston 36 begins to be moved from the left side to the right side with respect to the pneumatic cylinder body 34c. At this time, the air in the first air chamber 34a is released into the atmosphere without meeting any resistance. Accordingly, almost no reaction force produced by pressure within the first air chamber 34a acts upon the piston 36 and therefore the piston 36 begins moving at very high speed.

Next, at step S224, the controller 90 stands by until the piston 36 has moved to the position of the deceleration-position sensor 40 and the latter has responded by feeding a detection signal into the controller 90 from the IN port 94. When the detection signal enters from the IN port 94, the program proceeds to step S226.

The controller 90 turns on the solenoid 24 of the first solenoid valve 26 at step S226. As a result, the first port 26b1 of the second chamber 26b of first solenoid valve 26 is connected to the air passageway 19 and the third port 26b3 is connected to the air passageway 27 so that compressed air at a pressure of 294 KPa (3 kgf/cm$^2$) is fed into the first chamber 34a of pneumatic cylinder 34 from the second pressure regulator 18. At this time the compressed air from the second pressure regulator 18 is prevented from flowing back by the check valve 22. Consequently, there is no back flow of air from the first air chamber 34a of the pneumatic cylinder 34 and the pressure of the first air chamber 34a rises in reliable fashion. The piston 36 starts decelerating as a result.

Next, at step S228, the controller 90 stands by until the piston 36 has moved to the position of the stopping-position sensor 44 (the position at the right end of the pneumatic cylinder body 34c) and the latter has by responded by feeding a detection signal into the controller 90 from the IN port 94. When the detection signal enters from the IN port 94 at step S228, the program proceeds to step S220.

Since the controller 90 has verified that the piston 36 has already been moved to the right end of the pneumatic cylinder body 34c, the controller 90 delivers a control signal from the OUT port 92 to turn off the solenoid 24 of the first solenoid valve 26. As a result, the first solenoid valve 26 returns to the state shown in FIG. 2 (though it should be noted that the second solenoid valve 30 is not in the state shown in FIG. 2) so that the compressed air being held between the first air chamber 34*a* of the pneumatic cylinder 34 and the first solenoid valve 26 is discharged into the atmosphere from the muffler 20.

Further, the controller 90 measures the time that has elapsed from entry of the detection signal from the IN port 94 in response to operation of the stopping-position sensor 44. At elapse of 0.5 sec, the controller 90 delivers a signal from the OUT port 92 to turn off the solenoid 32 of the second solenoid valve 30. As a result, the second solenoid valve 30 returns to the state shown in FIG. 2 so that the compressed air being held between the second air chamber 34*b* of the pneumatic cylinder 34 and the second solenoid valve is discharged into the atmosphere from the muffler 20.

As a result of the foregoing operation, the pressure in the first air chamber 34*a* and second air chamber 34*b* of the pneumatic cylinder 34 become the same as atmospheric pressure approximately one second after the solenoid 32 is turned off. This ends the operation through which the piston 36 is moved from the left end to the right end of the cylinder in FIG. 2.

Second Embodiment

Figure 6:
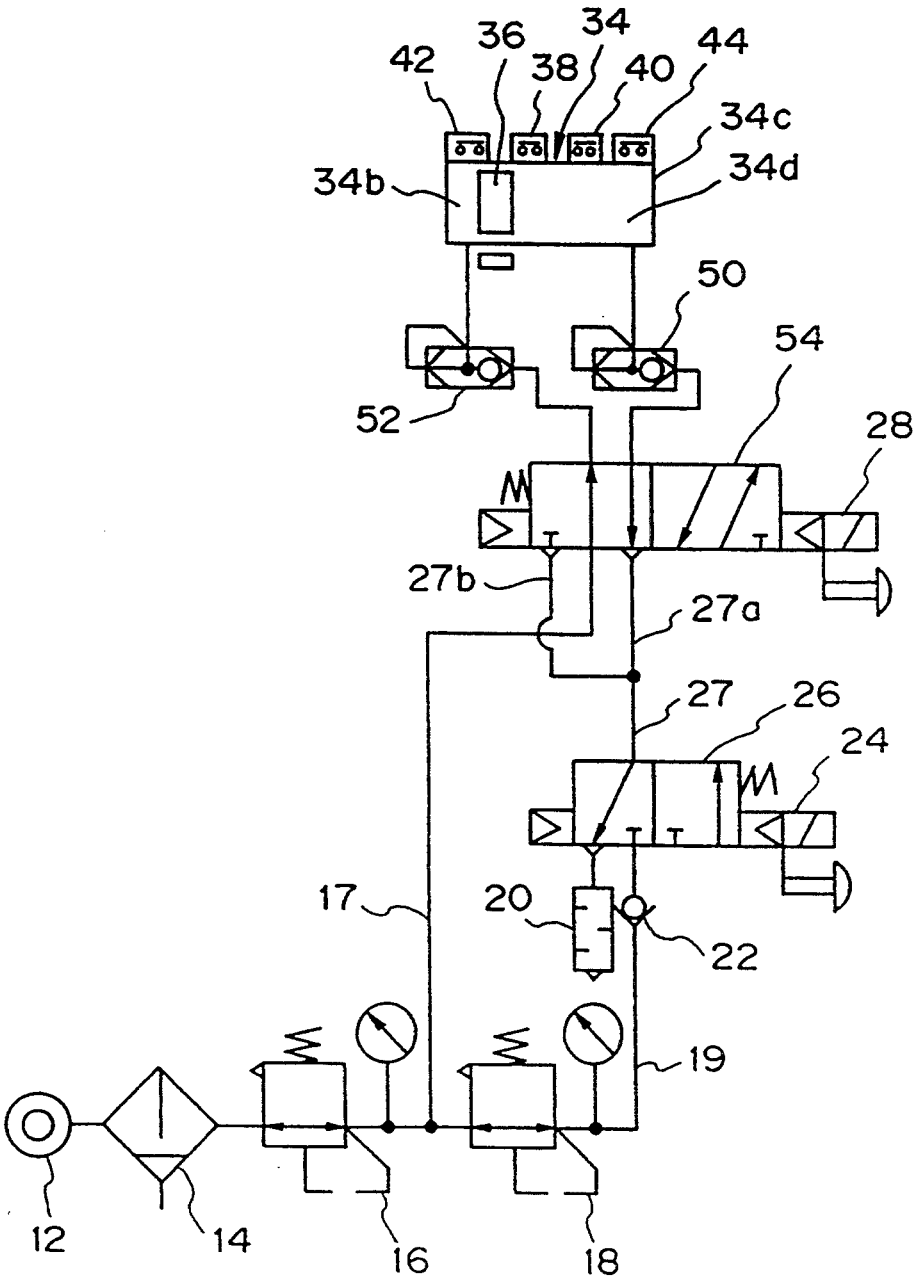
FIG. 6 is a pneumatic circuit diagram showing the arrangement of a cylinder apparatus according to a second embodiment of the invention.

FIG. 6 is a pneumatic circuit diagram showing the arrangement of a cylinder apparatus according to a second embodiment of the present invention.

In the cylinder apparatus of the second embodiment, a third solenoid valve 54 having two positions and five ports is provided in place of the second solenoid valve 30, and rapid exhaust valves 50, 52 are provided between the pneumatic 34 and the third solenoid valve 54. Other elements are exactly the same as those in the first embodiment and these are designated by like reference characters.

The second chamber of the second solenoid valve 30 in the first embodiment is deleted from the third solenoid valve 54.

Described first will be an operation through which the piston 36 is moved from the right side to the left side with respect to the pneumatic cylinder body 34*c*.

By operating the solenoid 28 of the third solenoid valve 54, air having a pressure of 490 KPa (5 kgf/cm$^2$) expelled from the first pressure regulator 16 is fed into the first air chamber 34*a* of the pneumatic cylinder 34. At the same time, the air within the second air chamber 34*b* of the pneumatic cylinder 34 is discharged into the atmosphere from the rapid exhaust valve 52 so that the piston 36 starts being moved from the right side to the left side in FIG. 6.

When the piston passes the position of the deceleration-position sensor 38, the latter responds and the controller 90 actuates the solenoid 24 of the first solenoid valve 26. Owing to operation of the solenoid 24, air at a pressure of 294 KPa (3 kgf/cm$^2$) expelled from the second pressure regulator 18 is fed into the second air chamber 34*b* of the pneumatic cylinder 34. The piston 38 starts being decelerated at the same time.

When the piston 36 reaches the position of the stopping-position sensor 42, the latter responds, the controller 90 receives the information from the sensor 42 and turns off the solenoid 24 of the first solenoid valve 26. As a result, the compressed air being held between the second air chamber 34*b* of the pneumatic cylinder 34 and the first solenoid valve 26 is discharged into the atmosphere from the muffler 20. This ends the operation for moving the piston 36 from the right side to the left side.

Described next will be an operation through which the piston 36 is moved from the left side to the: right side with respect to the pneumatic cylinder body 34*c*.

By turning off the solenoid 28 of the third solenoid valve 54, air having a pressure of 490 KPa (5 kgf/cm$^2$) expelled from the first pressure regulator 16 is fed into the second air chamber 34*b* of the pneumatic cylinder 34. At the same time, the air within the first air chamber 34*a* of the pneumatic cylinder 34 is discharged into the atmosphere from the rapid exhaust valve 50 so that the piston 36 starts being mowed from the left side to the right side in FIG. 6.

When the piston passes the position of the deceleration-position sensor 40, the latter responds and the controller 90 actuates the solenoid 24 of the first solenoid valve 26. Owing to operation of the solenoid 24, air at a pressure of 294 KPa (3 kgf/cm$^2$) expelled from the second pressure regulator 18 is fed into the first air chamber 34*a* of the pneumatic cylinder 34. The piston 38 starts being decelerated at the same time.

When the piston 36 reaches the position of the stopping-position sensor 44, the latter responds, the controller 90 receives the information from the sensor 42 and turns off the solenoid 24 of the first solenoid valve 26. As a result, the compressed air being held between the first air chamber 34*a* of the pneumatic cylinder 34 and the first solenoid valve 26 is discharged into the atmosphere from the muffler 20. This ends the operation for moving the piston 36 from the left side to the right side.

Further, owing to the provision of the check valve 22 between the solenoid valve 26 and the second pressure regulator 18, it is possible to prevent back flow of air from the pneumatic cylinder 34 when the air at a pressure of 294 KPa (3 kgf/cm$^2$) expelled from the pressure regulator 18 is fed into the pneumatic cylinder 34.

It should be noted that the present invention can be modified in various ways within the scope of the claims.

For example, though it is described that the first and second pressures of the compressed air are 490 KPa (5 kgf/cm$^2$) and 294 KPa (3 kgf/cm$^2$), respectively, in the foregoing embodiments, the present invention is not limited to these values and it is possible for these values to be changed.

Further, though it is described above that the feeding of compressed air into one air chamber and the discharge of air from the other air chamber are performed simultaneously, an arrangement may be adopted in which the compressed air is fed into the one air chamber after the air in the other air chamber is discharged.

Thus, in accordance with the cylinder apparatus and method of controlling same according to the embodiments of the invention as described above, the piston is capable of being moved at high speed by discharging air from the other of the chambers at the same time that compressed air of the first pressure is fed into the one chamber of the cylinder partitioned by the piston. Further, air of the second pressure lower than the first pressure is fed into the other chamber when the piston has reached a predetermined position, and the second pressure is changed, whereby a decelerating force suited to the weight of the object moved can be applied to the piston.

Further, the piston is braked by feeding the compressed air into the other chamber of the cylinder. As a result, no space is required for installing a spring-type shock absorber and, hence, the cylinder can be made more compact.

The present invention is not limited to the above embodiments and various changes and modifications can be made within the spirit and scope of the present invention. Therefore, to apprise the public of the scope of the present invention, the following claims are made.

What is claimed is:

1. A cylinder apparatus comprising:

a cylinder main body having a piston moved by fluid pressure, said cylinder main body being separated into first and second chambers by the piston;

a fluid supply source for supplying fluid of a first pressure for driving the piston;

first and second fluid pathways for distributing the fluid at the first pressure, supplied from said fluid supply source, into first and second flow paths;

pressure regulation means, provided on the second fluid pathway, for regulating pressure of the fluid supplied from said fluid supply source to a second pressure lower than the first pressure;

third and fourth fluid pathways connected to said first and second chambers, respectively, of said cylinder main body;

first fluid-path switching means for connecting said first and second fluid pathways to said third and fourth fluid pathways by switching between a first state where said first fluid pathway and said third fluid pathway are connected while said second fluid pathway and said fourth fluid pathway are connected, and a second state where said first fluid pathway and said fourth fluid pathway are connected while said second fluid pathway and said third fluid pathway are connected;

second fluid-path switching means, provided on said second fluid pathway, for switching between a state where fluid at the second pressure from said pressure regulation means is supplied to said first fluid pathway switching means, and a state where the fluid discharged from one of said chambers of said cylinder main body through said first fluid-path switching means is discharged to a discharge path provided independently of said second fluid pathway;

first position detection means for detecting a position of the piston and generating a detection signal; and control means for controlling a switching operation of said first and second fluid-path switching means, by controlling said first fluid-path switching means in accordance with a direction in which the piston is moved, and controlling said second fluid-path switching means based on the detection signal.

2. The apparatus according to claim 1, wherein said first fluid-path switching means comprises a single 3-position 5-port solenoid valve.

3. The apparatus according to claim 1, further comprising second position detection means for detecting a final position of the piston in said cylinder main body when the piston is moved, wherein said control means controls said first and second fluid-path switching means based on a detection result from said second position detection means.

* * * * *

UNITED STATES PATENT AND TRADEMARK OFFICE

CERTIFICATE OF CORRECTION

PATENT NO. : 5,365,827

DATED : November 22, 1994

INVENTOR(S) : Morita

It is certified that error appears in the above-indentified patent and that said Letters Patent is hereby corrected as shown below:

COLUMN 7:

Line 33, "by" should be deleted.

COLUMN 8:

Line 57, "by" should be deleted.

COLUMN 10:

Line 4, "the:" should read --the--.

Signed and Sealed this

Second Day of May, 1995

Bruce Lehman

*Attest:*

BRUCE LEHMAN

*Attesting Officer*

*Commissioner of Patents and Trademarks*